US010062474B2

(12) United States Patent
Kim et al.

(10) Patent No.: US 10,062,474 B2
(45) Date of Patent: Aug. 28, 2018

(54) TRANSPARENT ELECTRODE, CONDUCTIVE LAMINATE AND CONDUCTIVE LAYER

(75) Inventors: Ji Sung Kim, Seoul (KR); Hak Gee Jung, Yongin-si (KR); Jeong Han Kim, Seongnam-si (KR)

(73) Assignee: KOLON INDUSTRIES, INC., Gwacheon-si (KR)

( * ) Notice: Subject to any disclaimer, the term of this patent is extended or adjusted under 35 U.S.C. 154(b) by 686 days.

(21) Appl. No.: 12/750,058

(22) Filed: Mar. 30, 2010

(65) Prior Publication Data

US 2010/0244655 A1 Sep. 30, 2010

(30) Foreign Application Priority Data

Mar. 31, 2009 (KR) ..... 10-2009-0027334

(51) Int. Cl.
*H01J 1/02* (2006.01)
*H01B 1/24* (2006.01)

(52) U.S. Cl.
CPC ..... *H01B 1/24* (2013.01)

(58) Field of Classification Search
CPC ..... H01B 1/24
USPC ..... 428/195.1
See application file for complete search history.

(56) References Cited

U.S. PATENT DOCUMENTS

2009/0160089 A1* 6/2009 Oishi ..... B29C 41/28 264/289.6
2010/0181684 A1* 7/2010 Takahashi et al. ..... 257/774

FOREIGN PATENT DOCUMENTS

KR 10-2005-0001589 A 1/2005
KR 869161 B1 * 11/2008

OTHER PUBLICATIONS

"The Dispersion Stability of Multi-Walled Carbon Nanotubes in the Presence of Poly(styrene/alpha-methyl styrene/acrylic acid) Random Terpolymer," Chang et al., Macromolecular Research, 2006, vol. 14, No. 5, p. 545-551.*

* cited by examiner

*Primary Examiner* — Ian Rummel
(74) *Attorney, Agent, or Firm* — Sughrue Mion, PLLC

(57) ABSTRACT

Disclosed is a conductive layer including photopolymerizable resin having dispersed carbon nanotubes, which is transparent with high electrical conductivity and facilitates the formation of an electrode pattern. A laminate and a transparent electrode, including the conductive layer, are also provided.

13 Claims, No Drawings

TRANSPARENT ELECTRODE, CONDUCTIVE LAMINATE AND CONDUCTIVE LAYER

BACKGROUND OF THE INVENTION

1. Technical Field

The present invention relates to a transparent electrode, a conductive laminate and a conductive layer, and more particularly, to a transparent electrode which includes a conductive layer containing photopolymerizable resin and carbon nanotubes, and to a conductive laminate and a conductive layer.

2. Description of the Related Art

As computers and varieties of home appliances and communication devices are digitized and rapidly advance in performance, the demand for a display which has a large screen and is portable is urgent. In order to achieve a flexible display which is portable and has a large screen, there is a need for a display material which is foldable or rollable like a newspaper.

To this end, an electrode material for a display should be transparent with low resistivity and also should exhibit high strength so as to be mechanically stable when a device is bent or folded. Furthermore, this material should have a coefficient of thermal expansion similar to a coefficient of thermal expansion of a plastic substrate so as to prevent a short circuit from occurring or surface resistivity from greatly changing even when a device is overheated or is at high temperature.

Because a flexible display enables the fabrication of a display in predetermined form, it may be applied not only to portable display devices but also to clothing where it is able to change color or pattern, trademarks of clothing, signboards, price signs of display stands, and large electric lighting systems.

In this regard, a transparent conductive thin film is widely used for devices such as image sensors, solar cells, various displays (PDP, LCD, flexible), etc., which need both transmission of light and conductivity.

Although thorough research into indium tin oxide (ITO) for transparent electrodes for flexible displays has been conducted, the formation of a thin ITO film typically needs a process in a vacuum, which undesirably consumes high process costs. As well, in the case where a flexible display device is bent or folded, the lifespan thereof may be shortened because the thin film breaks.

In order to solve these problems, there has been developed a transparent electrode (Korean Unexamined Patent Publication No. 10-2005-001589) having a visible light transmittance of 80% or more and a surface resistivity of 100 Ω/sq or less by increasing conductivity while minimizing scattering of light in the visible light range, in which carbon nanotubes are chemically bound to a polymer and then formed into a film, or a conductive polymer layer is coated with purified carbon nanotubes or carbon nanotubes chemically bound to a polymer so that the carbon nanotubes are dispersed in nano scale inside or on the coating layer, and nanoparticles of metal such as gold or silver are mixed. Specifically, this transparent electrode was manufactured by reacting a dispersion solution of carbon nanotubes with polyethyleneterephthalate, thus preparing a high-concentration carbon nanotube-polymer copolymer solution, which is then applied on a polyester film and dried.

However, in the case where the above transparent electrode is used at high temperature, polymer deformation may occur and it is difficult to form the pattern of the electrode.

In addition, research into use of a conductive polymer which is an organic material as a material for a transparent electrode is being conducted. In the case of an electrode manufactured from a conductive polymer, conventional diverse polymer coating methods may be utilized, thus remarkably reducing the process cost and work. Specifically, in the fabrication of a flexible display or electric lighting system, a transparent electrode made of a conductive polymer such as polyacetylene, polypyrrole, polyaniline or polythiophene is advantageous in terms of process and is more flexible and breaks less, compared to transparent ITO electrodes. Accordingly, when an electrode which is very flexible is needed, in particular, when a touch screen is manufactured, the lifespan of the device may be advantageously prolonged. However, the conductive properties of an organic electrode made of conductive polymer are generally increased in proportion to thickness of the electrode. Furthermore, because the conductive polymer absorbs light in the visible light range, it should be applied thinly to increase transmittance in order to be adapted for a display. In the case where transmittance is increased in the visible light range in this way, it is difficult to satisfy surface resistivity required in application fields of transparent electrodes. In particular, in the case of using polythiophene (Baytron P, available from Bayer) in which conductive polymer nanoparticles are dispersed in water in order to increase processability, even when conductivity and coatability are improved using a solvent mixture, the application of such a polymer to a thickness of 50 nm on a substrate using spin coating makes it difficult to obtain a surface resistivity of 1 kΩ/sq or less.

Also, a conventional organic electrode material using carbon nanotubes is mainly provided in the form of a composite in which carbon nanotubes are simply mixed with a conductive polymer. As such, the carbon nanotubes aggregate extremely in a conductive polymer matrix due to strong Van der Waals force. Because of such aggregation of carbon nanotubes, it is difficult to form an electrode in which carbon nanotubes are uniformly dispersed despite superior conductive properties of carbon nanotubes. Moreover, even when carbon nanotubes are mixed in an amount of 1~10 wt % with the polymer, this mixture should be applied thickly in order to obtain satisfactory conductivity. The composite of carbon nanotubes and polymer which is applied thickly considerably reduces the transparency of electrode attributable to the carbon nanotubes aggregated in micro scale, and is inappropriate for use in a Hence, an organic transparent electrode material having high transparency and low surface resistivity even when carbon nanotubes are used in a small amount is required.

SUMMARY OF THE INVENTION

Accordingly, the present invention is intended to provide a transparent electrode which is superior in terms of light transmittance and electrical conductivity even in the form of a thin film.

Also, the present invention is intended to provide a conductive laminate which is superior in terms of light transmittance and electrical conductivity even in the form of a thin film.

Also, the present invention is intended to provide a conductive layer which is superior in terms of light transmittance and electrical conductivity even in the form of a thin film.

An aspect of the present invention provides a transparent electrode including a conductive layer, the conductive layer including carbon nanotubes and having at least two pyrolysis onsets showing at least 5% weight reduction in a pyrolysis range of 200~900° C., the pyrolysis range including a first pyrolysis range which initiates pyrolysis at 200~450° C. and shows a weight reduction of W1% and a second pyrolysis range which initiates pyrolysis at 450~700° C. and shows a weight reduction of W2%, and the W1/W2 being 0.1~20.

In this aspect, the transparent electrode may include the conductive layer obtained from a composition composed of an alkali-soluble binder resin, a photopolymerizable compound, a photoinitiator, and carbon nanotubes.

As such, the ratio of amount of carbon nanotubes and total amount of alkali-soluble binder resin and photopolymerizable compound may be 1:0.2~1:10.0 by weight based on solid content.

In this aspect, the transparent electrode may have a light transmittance of 70% or more at 550 nm and a surface resistivity of 1,000 Ω/sq or less, particularly favored being a light transmittance of 80% or more at 550 nm and a surface resistivity of 700 Ω/sq or less.

In this aspect, the conductive layer may have a thickness ranging from 10 nm to 5 μm.

In this aspect, the transparent electrode may be obtained by patterning the conductive layer using photolithography.

Another aspect of the present invention provides a conductive laminate including a substrate and a conductive layer, the conductive layer including carbon nanotubes and having at least two pyrolysis onsets showing at least 5% weight reduction in a pyrolysis range of 200~900° C., the pyrolysis range including a first pyrolysis range which initiates pyrolysis at 200~450° C. and shows a weight reduction of W1% and a second pyrolysis range which initiates pyrolysis at 450~700° C. and shows a weight reduction of W2%, and the W1/W2 being 0.1~20.

In this aspect, the conductive layer may be obtained from a composition composed of an alkali-soluble binder resin, a photopolymerizable compound, a photoinitiator, and carbon nanotubes.

As such, the ratio of amount of carbon nanotubes and total amount of alkali-soluble binder resin and photopolymerizable compound may be 1:0.2~1:10.0 by weight based on solid content.

In this aspect, the conductive layer may have a thickness ranging from 10 nm to 5 μm.

In this aspect, the conductive laminate may have a light transmittance of 70% or more at 550 nm and a surface resistivity of 1,000 Ω/sq or less.

In this aspect, the substrate may be a plastic film or a glass substrate.

A further aspect of the present invention provides a conductive layer including carbon nanotubes and having at least two pyrolysis onsets showing at least 5% weight reduction in a pyrolysis range of 200~900° C., the pyrolysis range including a first pyrolysis range which initiates pyrolysis at 200~450° C. and shows a weight reduction of W1% and a second pyrolysis range which initiates pyrolysis at 450~700° C. and shows a weight reduction of W2%, and the W1/W2 being 0.1~20.

In this aspect, the conductive layer may be obtained from a composition composed of an alkali-soluble binder resin, a photopolymerizable compound, a photoinitiator, and carbon nanotubes, in which the ratio of amount of carbon nanotubes and total amount of alkali-soluble binder resin and photopolymerizable compound may be 1:0.2~1:10.0 by weight based on solid content.

In this aspect, the conductive layer may have a thickness ranging from 10 nm to 5 μm, and may also have a light transmittance of 70% or more at 550 nm and a surface resistivity of 1,000 Ω/sq or less.

The present invention may provide a conductive layer in thin film form, which exhibits superior electrical conductivity with high transparency and facilitates the formation of circuit, and a conductive laminate and a transparent electrode.

DESCRIPTION OF SPECIFIC EMBODIMENTS

Hereinafter, a detailed description will be given of the present invention.

According to an embodiment of the present invention, a transparent electrode which is very transparent and has superior electrical conductivity may result from forming a conductive layer on a transparent substrate having heat resistance or may be a conductive layer directly obtained from an electrode composition.

The transparent substrate may be a glass substrate or a plastic film.

For example, a substrate which forms a film type transparent electrode is not particularly limited as long as it is a film which satisfies heat resistance and transparency. Particularly useful is a polyimide film having an average coefficient of linear thermal expansion (CTE) of 35.0 ppm/° C. or less measured at 50~250° C. using thermomechanical analysis at a film thickness of 50~100 μm, with a yellowness index of 15 or less.

If the average CTE measured at a film thickness of 50~100 μm is greater than 35.0 ppm/° C., a difference in CTE from a plastic substrate may be enlarged, and an undesirable short circuit may occur when a device is overheated or is at high temperature. Also, if the yellowness index is greater than 15, transparency is decreased, and hence, such a polyimide film is not adapted for a transparent electrode. As such, the average CTE which is obtained by measuring changes depending on temperature increments in a predetermined temperature range may be measured using a thermomechanical analyzer.

Also, particularly useful in terms of transmittance is a polyimide film which is colorless and transparent, especially a polyimide film having a yellowness index of 15 or less at a film thickness of 50~100 μm. Also, a polyimide film having an average transmittance of 85% or more at 380~780 nm measured using a UV spectrophotometer at a film thickness of 50~100 μm may be used as a plastic film. In the case of satisfying such transmittance, this polyimide film is usable as a plastic substrate for liquid crystal displays and transmissive e-paper. Furthermore, a plastic film may be a polyimide film having a transmittance of 88% or more at 550 nm and a transmittance of 70% or more at 420 nm measured using a UV spectrophotometer at a film thickness of 50~100 μm.

In terms of improving transparency resulting in increased transmittance, a polyimide film having color coordinates, in which L is 90 or more, a is 5 or less and b is 5 or less, measured using a UV spectrophotometer at a film thickness of 50~100 μm, may be used.

The polyimide film as above may be manufactured by polymerizing an aromatic dianhydride and an aromatic diamine, thus obtaining a polyamic acid which is then imidized. Examples of the aromatic dianhydride may include but are not limited to one or more selected from among 2,2-bis(3,4-dicarboxyphenyl)hexafluoropropane dianhydride (6-FDA), 4-(2,5-dioxotetrahydrofuran-3-yl)-1,2,3,4-tetrahydronaphthalene-1,2-dicarboxylic anhydride (TDA) and 4,4'-(4,4'-isopropylidenediphenoxy)bis(phthalic anhydride) (HBDA), one or more selected from among pyromellitic dianhydride (PMDA), biphenyltetracarboxylic dianhydride (BPDA) and oxydiphthalic dianhydride (ODPA).

Examples of the aromatic diamine may include but are not limited to one or more selected from among 2,2-bis[4-(4-aminophenoxy)-phenyl]propane (6HMDA), 2,2'-bis(trifluoromethyl)-4,4'-diaminobiphenyl (2,2'-TFDB), 3,3'-bis(trifluoromethyl)-4,4'-diaminobiphenyl (3,3'-TFDB), 4,4'-bis(3-aminophenoxy)diphenylsulfone (DBSDA), bis(3-aminophenyl)sulfone (3DDS), bis(4-aminophenyl)sulfone (ODDS), 1,3-bis(3-aminophenoxy)benzene (APB-133), 1,4-bis(4-aminophenoxy) benzene (APB-134), 2,2'-bis[3(3-aminophenoxy)phenyl]hexafluoropropane (3-BDAF), 2,2'-bis[4(4-aminophenoxy)phenyl]hexafluoropropane (4-BDAF), 2,2'-bis(3-aminophenyl)hexafluoropropane (3,3'-6F), 2,2'-bis(4-aminophenyl)hexafluoropropane (4,4'-6F) and oxydianiline (ODA).

The method of manufacturing a polyimide film from monomers is not particularly limited. For example, the polyimide film may be manufactured by polymerizing an aromatic diamine and an aromatic dianhydride in a first solvent, thus obtaining a polyamic acid solution, imidizing the polyamic acid solution, mixing the imidized solution with a second solvent, filtering and drying the mixture solution, thus obtaining a solid polyimide resin, and dissolving the solid polyimide resin in the first solvent, thus preparing a polyimide solution, which is then subjected to a film forming process. In this case, the second solvent may have lower polarity than the first solvent. Specifically, the first solvent may be one or more selected from among m-cresol, N-methyl-2-pyrrolidone (NMP), dimethylformamide (DMF), dimethylacetamide (DMAc), dimethylsulfoxide (DMSO), acetone and diethylacetate, and the second solvent may be one or more selected from among water, alcohols, ethers and ketones.

In the formation of a metal film on a plastic film, in order to form a conductive layer having a uniform thickness, the plastic film may have a surface roughness of 2 μm or less and preferably 0.001~0.04 μm.

Provided on such a transparent substrate film having heat resistance is a conductive layer. The conductive layer according to an embodiment of the present invention includes carbon nanotubes, and has at least two pyrolysis onsets showing at least 5% weight reduction in a pyrolysis range of 200~900° C., the pyrolysis range including a first pyrolysis range which initiates pyrolysis at 200~450° C. and shows a weight reduction of W1% and a second pyrolysis range which initiates pyrolysis at 450~700° C. and shows a weight reduction of W2%, and the W1/W2 being 0.1~20.

The first pyrolysis range is shown due to pyrolysis of a hydrocarbon-based compound. According to a preferred embodiment of the present invention, the first pyrolysis range may result from pyrolysis of an alkali-soluble binder resin and a photopolymerizable compound.

The second pyrolysis range is shown due to pyrolysis of carbon nanotubes used to impart conductivity.

When the weight reductions (%), W1 and W2, which are shown in the first and second pyrolysis ranges, satisfy W1/W2 of 0.1~20, the resulting conductive layer is preferable in terms of surface resistivity, light transmittance, mechanical strength of resin film itself, and adhesion to a substrate. If the W1/W2 is less than 0.1, the conductive layer may be reduced in adhesion to a substrate and mechanical strength, and it is difficult to form a circuit pattern. In contrast, if the W1/W2 exceeds 20, limitations in which surface resistivity is increased and light transmittance is lowered cannot be overcome even when other process conditions are varied. The W1 and W2 are not equal to the total amount of the hydrocarbon-based compound and the amount of carbon nanotubes, constituting the conductive layer, and predetermined error may be caused by metal element or flame retardant material contained in the hydrocarbon-based compound and carbon nanotubes, which will be apparent to those with ordinary skill in the art.

The conductive layer which exhibits such pyrolysis properties is advantageous because it may have superior close-contact and adhesion to a substrate, high mechanical strength of an electrode, and good pattern formability upon formation of an electrode pattern. Furthermore, the conductive layer may exhibit high conductivity even in the form of a thin film, resulting in high light transmittance.

As long as the conductive layer exhibits such pyrolysis properties, the composition thereof is not particularly limited. In particular, the conductive layer may be a resin layer in which carbon nanotubes are dispersed in a photopolymerizable resin composition.

The photopolymerizable resin composition is composed of an alkali-soluble binder resin, a photopolymerizable compound and a photoinitiator. The alkali-soluble binder polymer may include copolymer of (meth)acrylic acid and (meth)acrylic acid ester or alkali-soluble polymer resin such as hydroxypropyl methylcellulose acetate phthalate in order to enhance mechanical strength of a conductive layer such as scratch resistance.

The copolymer of (meth)acrylic acid and (meth)acrylic acid ester may be obtained through copolymerization of two or more monomers selected from among methyl acrylate, methyl methacrylate, ethyl acrylate, ethyl methacrylate, butyl acrylate, butyl methacrylate, acrylic acid, methacrylic acid, 2-hydroxy ethyl acrylate, 2-hydroxy ethyl methacrylate, 2-hydroxy propyl acrylate, 2-hydroxy propyl methacrylate, acryl amide, methacryl amide, styrene, and α-methyl styrene.

Such a copolymer may have an average molecular weight of 30,000~150,000 in consideration of close-contact and adhesion to a substrate, and a glass transition temperature of 20~150° C.

The photopolymerizable compound which initiates a reaction by a photoinitiator may have at least two terminal ethylene groups, and examples thereof may include 1,6-hexanediol(meth)acrylate, 1,4-cyclohexanediol(meth)acrylate, polypropyleneglycol(meth)acrylate, polyethyleneglycol(meth)acrylate, 2-di(p-hydroxyphenyl)-propane-di(meth) acrylate, glycerol tri(meth)acrylate, trimethylol propane tri (meth)acrylate, polyoxy propyl trimethylol propane tri (meth)acrylate, bisphenol A-containing polyethylene (propylene) di(meth)acrylate, and urethane-containing multifunctional (meth)acrylate.

The amounts of copolymer and photopolymerizable compound may be set in consideration of coatability, follow-up capability, and mechanical strength of pattern itself after formation of circuit. The amount of copolymer may be set to 20~80 wt % based on the resin composition except for carbon nanotubes. The amount of photopolymerizable compound may be set to 15~70 wt % based on solid content of the resin composition except for carbon nanotubes.

The photoinitiator initiates a chain reaction with a photopolymerizable oligomer by UV light and other radiations, and examples thereof may include anthraquinone derivatives such as 2-methyl anthraquinone and 2-ethyl anthraquinone, and benzoin derivatives such as benzoin methyl ether, benzophenone, phenanthrenequinone and 4,4'-bis-(dimethylamino)benzophenone. In addition, there is exemplified a compound selected from among 1-hydroxycyclohexylphenylketone, 2,2-dimethoxy-1,2-diphenylethan-1-one, 2-methyl-1-[4-(methylthio)phenyl]-2-morpholinopropan-1-one, 2-benzyl-2-dimethylamino-1-[4-morpholinophenyl]butan-1-one, 2-hydroxy-2-methyl-1-phenylpropan-1-one, 2,4,6-trimethylbenzoyldiphenylphosphine oxide, 1-[4-(2-hydroxymethoxy)phenyl]-2-hydroxy-2-methylpropan-1-one, 2,4-diethylthioxanthone, 2-chlorothioxanthone, 2,4-dimethylthioxanthone, 3,3-dimethyl-4-methoxybenzophenone, benzophenone, 1-chloro-4-propoxythioxanthone, 1-(4-isopropylphenyl)-2-hydroxy-2-methylpropan-1-one, 1-(4-dodecylphenyl)-2-hydroxy-2-methylpropan-1-one, 4-benzoyl-4'-methyldimethylsulfide, 4-dimethylaminobenzoic acid, methyl 4-dimethylaminobenzoate, ethyl 4-dimethylaminobenzoate, butyl 4-dimethylaminobenzoate, 2-ethylhexyl 4-dimethylaminobenzoate, 2-isoamyl 4-dimethylaminobenzoate, 2,2-diethoxyacetophenone, benzylketone dimethylacetal, benzylketone β-methoxy diethylacetal, 1-phenyl-1,2-propyldioxime-o,o'-(2-carbonyl)ethoxyether, methyl o-benzoylbenzoate, bis[4-dimethylaminophenyl)ketone, 4,4'-bis(diethylamino)benzophenone, 4,4'-dichlorobenzophenone, benzyl, benzoin, methoxybenzoin, ethoxybenzoin, isopropoxybenzoin, n-butoxybenzoin, isobutoxybenzoin, tert-butoxybenzoin, p-dimethylaminoacetophenone, p-tert-butyltrichloroacetophenone, p-tert-butyldichloroacetophenone, thioxanthone, 2-methylthioxanthone, 2-isopropylthioxanthone, dibenzosuberone, α,α-dichloro-4-phenoxyacetophenone, and pentyl 4-dimethylaminobenzoate.

The amount of photoinitiator may be set to 1~10 wt % based on the resin composition except for carbon nanotubes.

The carbon nanotubes are not particularly limited, and examples thereof may include single-walled carbon nanotubes (SWCNT), double-walled carbon nanotubes (DWCNT), and multi-walled carbon nanotubes (MWCNT).

Taking into consideration dispersibility, carbon nanotubes may be dispersed optionally along with a dispersant in an organic solvent and then subjected to sonication so as to uniformly disperse carbon nanotubes, thus obtaining a dispersion solution of carbon nanotubes. The dispersion of carbon nanotubes is not particularly limited, and may include for example physical dispersion using sonication, a three-roll mill, a homogenizinger, a kneader, a mill-blender, or a ball mill. Also, the carbon nanotubes may be added to the photopolymerizable resin composition through blending or mixing. Also, in order to appropriately disperse carbon nanotubes, an additive such as a dispersant or an emulsifier may be used.

The formation of conductive layer having dispersed carbon nanotubes may include but is not limited to for example spray coating, spin coating, or casting using a doctor blade.

As such, in terms of surface resistivity and light transmittance of an electrode film for a display, the ratio of amount of carbon nanotubes and total amount of alkali-soluble polymer and photopolymerizable compound may be 1:0.2~1:10 by weight based on solid content.

The dispersion solution of carbon nanotubes may be mixed with the photopolymerizable resin composition, after which this mixture may be applied on a predetermined substrate thus forming a conductive layer. In particular, the mixture may be applied on a glass substrate or a plastic substrate thus obtaining a conductive laminate, which may also be used as a transparent electrode.

Furthermore, the conductive layer may be patterned using photolithography so as to be used as a transparent electrode including a conductive resin layer having formed circuit. Specifically, a photomask for forming circuit may be placed on the conductive layer, followed by performing exposure and development, thus manufacturing an electrode pattern.

Also in the case where a film type transparent electrode is to be formed, the composition for a conductive layer may be applied on a transparent substrate film having heat resistance, and the solvent is then dried, thus obtaining a transparent electrode film having a conductive layer.

The procedure of forming the electrode pattern from the transparent electrode film may include placing a photomask for forming circuit on the conductive layer and then performing exposure and development, as in the aforementioned photolithography, thus manufacturing an electrode pattern.

Herein, the binder polymer, the photopolymerizable oligomer, and the photoinitiator mentioned as above do not limit the present invention, and may be modified as various compounds within a range that does not change the scope of the present invention, which will be apparent to those with ordinary skill in the art.

When the conductive layer having dispersed carbon nanotubes may be formed to a thickness ranging from 10 nm to 5 μm, it is favorable in terms of exhibiting good conductivity of a conductive layer, inhibiting deterioration of optical properties of a display such as transmittance and forming a good electrode pattern. If the thickness of the conductive layer is thinner than 10 nm, surface resistivity of the conductive layer may be increased undesirably lowering conductivity, and furthermore the conductive layer may become weak in an alkali solution, making it difficult to form circuit. In contrast, if the thickness thereof is thicker than 5 μm, light transmittance may be lowered, and the conductive layer is inappropriate for use in a display device.

The transparent electrode film including the conductive layer thus obtained may be improved in electrical conductivity without deteriorating transmittance of incident light, resulting in a bright image.

In order to be adapted as a transparent electrode, the transparent electrode film according to an embodiment of the present invention may have a surface resistivity of 1000 Ω/sq or less, and a light transmittance of 70% or more at a wavelength of 550 nm. Preferably, light transmittance may be 80% or more at 550 nm, and surface resistivity may be 700 Ω/sq or less.

Also the conductive layer may have a surface resistivity of 1000 Ω/sq or less, and a light transmittance of 70% or more at a wavelength of 550 nm. Preferably, light transmittance may be 80% or more at 550 nm, and surface resistivity may be 700 Ω/sq or less.

A better understanding of the present invention may be obtained by the following examples which are set forth to illustrate, but are not to be construed as limiting the present invention.

<Manufacture of Polyimide Substrate Film>

PREPARATIVE EXAMPLE 1

In order to form a polyimide film which is a kind of organic insulating film, a precursor solution was first prepared. Specifically, 2,2-f-bis(trifluoromethyl)-4,4'-diaminobiphenol (2,2'-TFDB), biphenyltetracarboxylic dianhydride (BPDA), and 2,2-bis(3,4-dicarboxyphenyl)hexafluoropropane dianhydride (6-FDA) were condensed in dimethylacetamide using a known method, thereby obtaining a polyimide precursor solution (solid content 20%) which is a kind of precursor solution of organic insulating film. This reaction is represented by Reaction 1 below.

Reaction 1

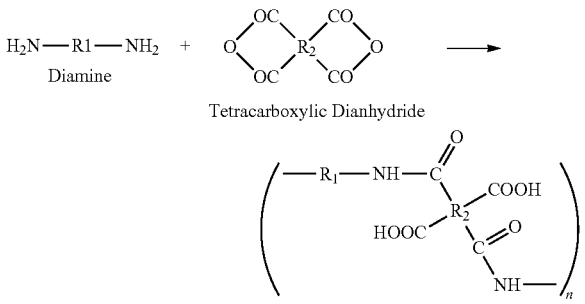

Thereafter, according to the process known above, 300 g of the polyimide precursor solution was added with 2~4 equivalents of each of acetic anhydride (acetic oxide, available from SamChun) and pyridine (available from SamChun) as chemical curing agents, after which the resulting polyamic acid solution was heated at a heating rate of 1~10° C./min within a temperature range of 20~180° C. for 2~10 hours, so that the polyamic acid solution was partially imidized and cured, thereby preparing a solution containing a partially imidized (partially cured) intermediate.

Reaction 2 below represents the preparation of a polyimide film by heating the polyimide precursor. In an embodiment of the present invention, polyimide is obtained not by imidizing the entire precursor solution but by imidizing a predetermined proportion of the precursor.

Reaction 2

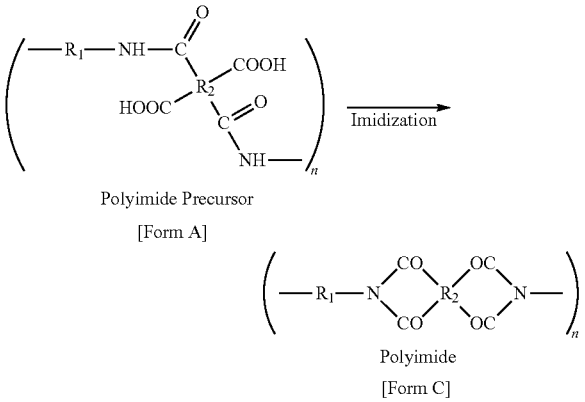

Specifically, the polyimide precursor solution is heated and stirred under predetermined conditions, thus generating dehydration and ring closure between the hydrogen atom of the amide group of the polyimide precursor and the carboxylic group. As represented by Formula 1 below, an intermediate portion of Form B and an imide portion of Form C are produced by the reaction as represented in Reaction 2. Also, in the molecular chain, a polyimide precursor portion of Form A in which dehydration does not completely occur exists.

In the molecular chain in which the polyimide precursor is partially imidized, as represented by Formula 1 below, Form A (polyimide precursor portion), Form B (intermediate portion), and Form C (imide portion) are mixed.

Formula 1

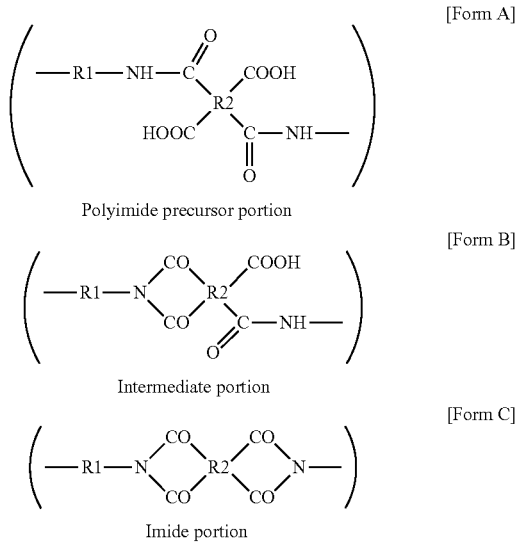

30 g of the imidized solution having the above mixed structure was added to 300 g of water to precipitate it, and the precipitated solid was then filtered and milled, thus obtaining powder, which was then dried in a vacuum oven at 80~100° C. for 2~6 hours, thus obtaining about 8 g of solid resin powder. Through the above procedure, the polyimide precursor portion of Form A was converted into Form B or C. The solid resin was dissolved in 32 g of DMAc or DMF serving as a polymerization solvent, thus obtaining a 20 wt % polyimide solution. The polyimide solution was heated at a heating rate of 1~10° C./min within a temperature range of 40~400° C. for 2~8 hours, resulting in polyimide films having a thickness of 50 μm and 100 μm.

The state in which the polyimide precursor is partially imidized is represented by Reaction 3 below.

Reaction 3

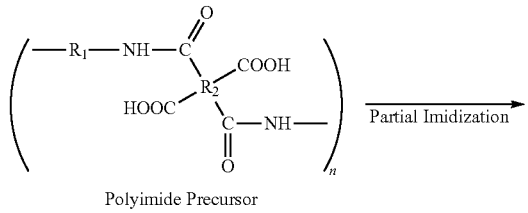

$Am_1$-$Bm_2$-$Cm_3$ $(m_1 + m_2 + m_3 = n)$

For example, under the above conditions, about 45~50% of the precursor is imidized and cured. An imidization rate in which part of the precursor is imidized may be easily controlled by varying the heating temperature or time, and may be set to about 30~90%.

In the process of imidizing part of the polyimide precursor, water may be generated when the polyimide precursor is imidized through dehydration and ring closure. However, this water may cause hydrolysis of amide of the polyimide precursor or cleavage of the molecular chain, undesirably reducing stability. Thus, water should be removed through addition of an azeotropic reaction using toluene or xylene upon heating of the polyimide precursor solution or through volatilization of the aforementioned dehydrating agent.

Thereafter, a process of preparing a coating solution is described below. Specifically, the partially cured intermediate was added to the solvent used in the preparation of the polyimide precursor at a ratio of 100 parts by weight of the solution and 20~30 parts by weight of the polyimide precursor, thus preparing a uniform coating solution.

Subsequently, the above resin solution was applied on a substrate for film formation such as glass or SUS through spin coating or casting using a doctor blade and then dried at high temperature as mentioned above, thus forming a film 50 μm thick. The film thus formed was not subjected to a process of stretching any one surface of the film in isolation on the basis of the vertical/horizontal axis, and thus had the same refractive index for the entire surface thereof.

PREPARATIVE EXAMPLE 2

While nitrogen was passed through a 100 ml three-neck round bottom flask reactor equipped with a stirrer, a nitrogen inlet, a dropping funnel, a temperature controller and a condenser, 34.1904 g of N,N-dimethylacetamide (DMAc) was placed in the reactor, the temperature of the reactor was decreased to 0° C., 4.1051 g (0.01 mol) of 6-HMDA was dissolved therein, and then this solution was maintained at 0° C. Further, 4.4425 g (0.01 mol) of 6-FDA was added thereto and stirred for 1 hour, thus completely dissolving the 6-FDA. The solid content was thus 20 wt %. The solution was then stirred at room temperature for 8 hours, thus obtaining a polyamic acid solution having a viscosity of 2400 cps at 23° C.

Subsequently, the polyamic acid solution obtained after completion of the reaction was cast to a thickness of 500~1000 μm on a glass substrate using a doctor blade, and dried in a vacuum oven at 40° C. for 1 hour and at 60° C. for 2 hours, thus obtaining a self-supporting film, which was then heated in a high-temperature oven at 80° C. for 3 hours, 100° C. for 1 hour, 200° C. for 1 hour and 300° C. for 30 min at a heating rate of 5° C./min, thereby manufacturing a polyimide film having a thickness of 50 μm.

PREPARATIVE EXAMPLE 3

As in Preparative Example 2, 2.9233 g (0.01 mol) of APB-133 was dissolved in 29.4632 g of DMAc, after which 4.4425 g (0.01 mol) of 6-FDA was added thereto and stirred for 1 hour, thus completely dissolving the 6-FDA. The solid content was thus 20 wt %. The solution was then stirred at room temperature for 8 hours, thus obtaining a polyamic acid solution having a viscosity of 1200 cps at 23° C.

Subsequently, the same process as in Preparative Example 2 was performed, thus manufacturing a polyimide film.

The properties of the polyimide films manufactured in Preparative Examples 1~3 were measured as follows. The results are shown in Table 1 below.

(1) Transmittance and Color Coordinates

The visible light transmittance of the polyimide film was measured using a UV spectrophotometer (Cary100, available from Varian).

The color coordinates of the polyimide film were measured using a UV spectrophotometer (Cary100, available from Varian) according to ASTM E 1347~06. As such, a standard illuminant was CIE D65.

(2) Yellowness Index

The yellowness index of the polyimide film was measured according to ASTM E313.

(3) Coefficient of Linear Thermal Expansion (CTE)

The average CTE of the polyimide film was determined at 50~250° C. according to a TMA method using a TMA (Q400, available from TA Instrument).

TABLE 1

| | | Thick. | CTE | | Transmittance | | | | | Color Coordinates | | |
|---|---|---|---|---|---|---|---|---|---|---|---|---|
| | | (μm) | (ppm/° C.) | Yellow. | 380~780 nm | 551~780 nm | 550 nm | 500 nm | 420 nm | L | a | b |
| Pre. | 1 | 50 | 21.6 | 2.46 | 86.9 | 90.5 | 89.8 | 89.3 | 84.6 | 96.22 | −0.27 | 1.03 |
| Ex. | 2 | 50 | 46 | 1.59 | 87.6 | 90.0 | 89.7 | 89.2 | 85.4 | 95.85 | −0.12 | 0.99 |
| | 3 | 50 | 46.0 | 6.46 | 83.8 | 88.8 | 87.2 | 84.8 | 73.2 | 94.6 | 0.59 | 5.09 |

EXAMPLES 1~10

On the polyimide film of Preparative Examples 1~3, a composition for a conductive layer composed of components as shown in Table 2 below was applied in the form of a thin film using spraying, thus forming a conductive layer having dispersed carbon nanotubes.

Specifically, the carbon nanotubes were a dispersion solution of carbon nanotubes obtained by adding carbon nanotubes optionally along with a dispersant including polyvinylpyrrolidone (PVP) or Nafion, to isopropylalcohol, and then performing sonication under conditions of 200 W and 40 kHz.

Subsequently, the dispersion solution of carbon nanotubes was mixed with an alkali-soluble binder resin, a photopolymerizable compound and a photoinitiator in a solvent such as acetate, alcohol or ketone, thus obtaining the composition for a conductive layer. As such, the solid content of the composition was adjusted so as to form a conductive layer having a desired thickness.

Subsequently, such a composition for a conductive layer was applied on the polyimide film using spraying and spin coating, and then dried in a hot-air oven at 120° C., thus forming a conductive layer as a photopolymerizable resin layer having dispersed carbon nanotubes.

As such, the thickness of the conductive layer was measured by observing the cross-section of the manufactured transparent electrode film using a scanning electron microscope (SEM).

TABLE 2

| | | Conductive layer (amount: wt %) | | | | | | |
|---|---|---|---|---|---|---|---|---|
| | Polyimide Film | Thick. (μm) | CNT1 | CNT2 | Dispersant | Alkali-soluble Binder Resin | Photo-polymerizable. Compound | Photo-initiator |
| Ex. 1 | Pre. Ex. 1 | 0.1 | 80 | 0 | 0 | 9.8 | 9.8 | 0.4 |
| Ex. 2 | Pre. Ex. 2 | 0.2 | 50 | 0 | 0 | 19 | 30 | 1 |
| Ex. 3 | Pre. Ex. 3 | 0.2 | 50 | 0 | 0 | 24 | 25 | 1 |
| Ex. 4 | Pre. Ex. 1 | 0.2 | 50 | 0 | 0 | 24 | 25 | 1 |
| Ex. 5 | Pre. Ex. 1 | 0.4 | 30 | 0 | 0 | 45 | 24 | 1 |
| Ex. 6 | Pre. Ex. 1 | 0.5 | 10 | 0 | 0 | 60 | 39 | 1 |
| Ex. 7 | Pre. Ex. 1 | 0.2 | 47.5 | 0 | 2.5 | 30 | 19 | 1 |
| Ex. 8 | Pre. Ex. 1 | 1.0 | 47.5 | 0 | 2.5 | 30 | 19 | 1 |
| Ex. 9 | Pre. Ex. 1 | 2.5 | 47.5 | 0 | 2.5 | 30 | 19 | 1 |
| Ex. 10 | Pre. Ex. 1 | 0.1 | 0 | 45 | 5 | 24 | 25 | 1 |

Note:
CNT1: single-walled carbon nanotubes, SPH1128, available from Unidym
CNT2: multi-walled carbon nanotubes, VGCF-X, available from Showa Denko
Alkali-soluble binder resin: hydroxypropyl methylcellulose acetate phthalate
Photopolymerizable compound: mixture composed of PU-280 available from Miwon Commercial and HX-220 available from Nippon Kayaku at 40:60 wt %
Photoinitiator: mixture composed of benzophenone and 4,4-bis(diethylamino)benzophenone at 50:50 wt %

COMPARATIVE EXAMPLE 1

A conductive layer composed of 95.0 wt % of CNT1, 2.5 wt % of alkali-soluble binder resin, 2.4 wt % of a photopolymerizable compound, and 0.25 wt % of a photoinitiator was formed using the same process as in Example 1.

COMPARATIVE EXAMPLE 2

A conductive layer composed of 4.0 wt % of CNT1, 50 wt % of alkali-soluble binder resin, 45 wt % of a photopolymerizable compound, and 1 wt % of a photoinitiator was formed using the same process as in Example 1.

TEST EXAMPLE 1

The properties of the transparent electrode films obtained in Examples 1~10 and Comparative Examples 1~2 were evaluated as follows. The results are shown in Tables 3 and 4 below.

(1) Optical Properties

The visible light transmittance of the transparent electrode film in a state in which circuit was not formed was measured using a UV spectrophotometer (CM-3700d, available from Konika Minolta).

(2) Surface Resistivity

The surface resistivity of the conductive layer for the transparent electrode film in a state in which circuit was not formed was measured. After ten measurements of surface resistivity using an ohmmeter (CMT-SR 2000N, available from Advanced Instrument Technology (AIT), 4-Point Probe System, measurement range: $10\times10^{-3}$~$10\times10^{5}$), the measured values were averaged.

(3) Formed Pattern State

The electrode pattern was formed in such a manner that the transparent conductive layer was exposed to UV light at 10~40 mJ depending on the thickness of the resin film using an OB7120 parallel light exposure device available from PerkinElmer by means of a photomask for circuit evaluation, allowed to stand for 20 min, and then developed through spraying using a 1.0 wt % sodium carbonate aqueous solution thus forming circuit. The pattern thus formed was then observed using a magnifier. The results in which the electrode layer was observed at the exposed portion and the conductive layer was removed at the non-exposed portion were evaluated to be good. The results in which the electrode layer did not form circuit at the exposed portion or the conductive layer was not removed at the non-exposed portion were evaluated to be poor.

(4) Thermogravimetric Analysis (TGA)

Analytical equipment: TGA7 (available from PerkinElmer)

Analytical sample: solid obtained by dissolving in methanol the conductive layer before curing the manufactured transparent electrode film and then drying it, or a conductive layer separated from the substrate film.

Analytical Conditions

Segment 1: 30~200° C., 20° C./min, Air purge

Segment 2: 200° C., 10 min Holding, Air purge

Segment 3: 200~900° C., 20° C./min, Air purge

Segment 4: 900° C., 10 min Holding, Air purge

Pyrolysis initiation temperature: temperature which causes 5% weight reduction from the initial weight ratio of Segment 3 at 200~450° C.

Pyrolysis onset: temperature corresponding to an inflection point after initiation of pyrolysis

TABLE 3

| | Surface Resistivity (Ω/sq) | Transmittance (%, at 550 nm) | Formed Pattern State |
|---|---|---|---|
| Ex. 1 | 156 | 85.2 | Good |
| Ex. 2 | 667 | 86.2 | Good |
| Ex. 3 | 525 | 82.6 | Good |
| Ex. 4 | 780 | 83.5 | Good |
| Ex. 5 | 780 | 77.5 | Good |
| Ex. 6 | 824 | 72.1 | Good |
| Ex. 7 | 428 | 77.2 | Good |
| Ex. 8 | 372 | 75.3 | Good |
| Ex. 9 | 338 | 71.0 | Good |
| Ex. 10 | 920 | 72.9 | Good |
| Com. Ex. 1 | 122 | 84.2 | Poor |
| Com. Ex. 2 | $4.2\times10^{4}$ | 87.1 | Good |

TABLE 4

| | Pyrolysis Initiation Temp. (° C.) | 1st Pyrolysis Range Pyrolysis Onset (° C.) | 1st Pyrolysis Range Weight Reduction W1 (%) | 2nd Pyrolysis Range Pyrolysis Onset (° C.) | 2nd Pyrolysis Range Weight Reduction W2 (%) | W1/W2 |
|---|---|---|---|---|---|---|
| Ex. 1 | 252 | 370 | 18.2 | 512 | 75.0 | 0.24 |
| Ex. 2 | 245 | 368 | 47.1 | 513 | 47.2 | 0.99 |
| Ex. 3 | 244 | 369 | 47.0 | 511 | 47.0 | 1.00 |
| Ex. 4 | 243 | 369 | 46.9 | 512 | 47.1 | 0.99 |
| Ex. 5 | 234 | 370 | 68.2 | 512 | 28.0 | 2.43 |
| Ex. 6 | 226 | 368 | 87.4 | 513 | 9.1 | 9.60 |
| Ex. 7 | 241 | 365 | 47.4 | 511 | 44.1 | 1.07 |
| Ex. 8 | 242 | 366 | 47.2 | 512 | 44.2 | 1.06 |
| Ex. 9 | 244 | 372 | 46.9 | 513 | 44.2 | 1.06 |
| Ex. 10 | 241 | 369 | 47.3 | 625 | 41.2 | 1.14 |
| Com. Ex. 1 | 250 | 368 | 4.55 | 513 | 89.1 | 0.05 |
| Com. Ex. 2 | 252 | 370 | 87.4 | 514 | 3.8 | 23.0 |

As is apparent from Tables 3 and 4, the conductive layer including carbon nanotubes according to the embodiment of the present invention can be seen to enable the manufacture of a transparent electrode having superior conductivity and light transmittance and to facilitate the formation of a circuit pattern.

Although the embodiments of the present invention have been disclosed for illustrative purposes, those skilled in the art will appreciate that a variety of different modifications, additions and substitutions are possible, without departing from the scope and spirit of the invention as disclosed in the Accordingly, such modifications, additions and substitutions should also be understood as falling within the scope of the present invention.

What is claimed is:

1. A transparent electrode comprising a substrate and a conductive layer provided on a surface of the substrate, the conductive layer comprising carbon nanotubes and having at least two pyrolysis onsets showing at least 5% weight reduction in a pyrolysis range of 200-900° C., the pyrolysis range including a first pyrolysis range which initiates pyrolysis at 200-450° C. and shows a weight reduction of W1% and a second pyrolysis range which initiates pyrolysis at 450-700° C. and shows a weight reduction of W2%, and the W1/W2 being 0.1-20;

wherein the conductive layer is obtained from a composition comprising an alkali-soluble binder resin, a photopolymerizable compound, a photoinitiator, and carbon nanotubes, in which a ratio of an amount of the carbon nanotubes and a total amount of the alkali-soluble binder resin and the photopolymerizable compound is 1:0.2 to 1:10.0 by weight, and a ratio of an amount of the alkali-soluble binder resin and an amount of the photopolymerizable compound is 1:0.1 to 1:2 by weight;

wherein the alkali-soluble binder resin and the photopolyerizable compound are different from each other, and the alkali-soluble binder resin is a copolymer of (meth) acrylic and (meth)acrylic acid ester, or a hydroxypropyl methylcellulose acetate phthalate ester;

wherein the substrate is a polyimide film manufactured by polymerizing an aromatic dianhydride and an aromatic diamine to form a polyamic acid, which is then subject to an imidization to give the polyimide film, and wherein the polyimide film has an average coefficient of linear thermal expansion of 35 ppm/° C. or less measured at 50-250° C. using thermomechanical analysis at a film thickness of 50-100 μm;

wherein the aromatic dianhydride includes one or more selected from the group consisting of 2,2-bis(3,4-dicarboxyphenyl)hexafluoropropane dianhydride, 4-(2,5-dioxotetrahydrofuran-3-yl)-1,2,3,4-tetrahydronaphthalene-1,2-dicarboxylic anhydride, 4,4'-(4,4'-isopropylidenediphenoxy)bis(phthalic anhydride), pyromellitic dianhydride, biphenyltetracarboxylic dianhydride, and oxydiphthalic dianhydride; and wherein the aromatic diamine includes one or more selected from the group consisting of 2,2-bis[4-(4-aminophenoxy)-phenyl]propane, 2,2'-bis(trifluoromethyl)-4,4'-diaminobiphenyl, 3,3'-bis(trifluoromethyl)-4,4'-diaminobiphenyl, 4,4'-bis(3-aminophenoxy) diphenylsulfone, bis(3-aminophenyl)sulfone, bis(4-aminophenyl)sulfone, 1,3-bis(3-aminophenoxy) benzene, 1,4-bis(4-aminophenoxy)benzene, 2,2'bis[3 (3-aminophenoxy)phenyl]hexafluoropropane, 2,2'-bis [4(4-aminophenoxy)phenyl]hexafluoropropane, 2,2'-bis(3-aminophenyl)hexafluoropropane, 2,2'-bis(4-aminophenyl)hexafluoropropane, and oxydianiline.

2. The transparent electrode as set forth in claim 1, wherein the conductive layer has a thickness ranging from 10 nm to 5 μm.

3. The transparent electrode as set forth in claim 1, having a light transmittance of 70% or more at 550 nm and a surface resistivity of 1,000 Ω/sq or less.

4. The transparent electrode as set forth in claim 1, obtained by patterning the conductive layer using photolithography.

5. The transparent electrode as set forth in claim 1, wherein the copolymer of (meth) acrylic acid and (meth) acrylic acid ester further comprises a monomeric unit selected from the group consisting of acryl amide, methacryl amide, styrene, and α-methyl styrene.

6. A conductive laminate comprising a substrate and a conductive layer, the conductive layer comprising carbon nanotubes and having at least two pyrolysis onsets showing at least 5% weight reduction in a pyrolysis range of 200-900° C., the pyrolysis range including a first pyrolysis range which initiates pyrolysis at 200-450° C. and shows a weight reduction of W1% and a second pyrolysis range which initiates pyrolysis at 450-700° C. and shows a weight reduction of W2%, and the W1/W2 being 0.1-20;

wherein the conductive layer is obtained from a composition comprising an alkali-soluble binder resin, a photopolymerizable compound, a photoinitiator, and carbon nanotubes, in which a ratio of an amount of the carbon nanotubes and a total amount of the alkali-soluble binder resin and the photopolymerizable compound is 1:0.2 to 1:10.0 by weight, and a ratio of an amount of the alkali-soluble binder resin and an amount of the photopolymerizable compound is 1:0.1 to 1:2 by weight;

wherein the alkali-soluble binder resin and the photopolyerizable compound are different from each other, and the alkali-soluble binder resin is a copolymer of (meth) acrylic and (meth)acrylic acid ester, or a hydroxypropyl methylcellulose acetate phthalate ester;

wherein the substrate is a polyimide film manufactured by polymerizing an aromatic dianhydride and an aromatic diamine to form a polyamic acid, which is then subject to an imidization to give the polyimide film, and wherein the polyimide film has an average coefficient of linear thermal expansion of 35 ppm/° C. or less measured at 50-250 ° C. using thermomechanical analysis at a film thickness of 50-100 μm;

wherein the aromatic dianhydride includes one or more selected from the group consisting of 2,2-bis(3,4-dicarboxyphenyl)hexafluoropropane dianhydride, 4-(2,5-dioxotetrahydrofuran-3-yl)-1,2,3,4-tetrahydronaphthalene-1,2-dicarboxylic anhydride, 4,4'-(4,4-isopropylidenediphenoxy)bis(phthalic anhydride), pyromellitic dianhydride, biphenyltetracarboxylic dianhydride, and oxydiphthalic dianhydride; and wherein the aromatic diamine includes one or more selected from the group consisting of 2,2-bis[4-(4-aminophenoxy)-phenyl]propane, 2,2'-bis(trifluoromethyl)-4,4'-diaminobiphenyl, 3,3'-bis(trifluoromethyl)-4,4'-diaminobiphenyl, 4,4'-bis(3-aminophenoxy) diphenylsulfone, bis(3-aminophenyl)sulfone, bis(4-aminophenyl)sulfone, 1,3-bis(3-aminophenoxy) benzene, 1,4-bis(4-aminophenoxy)benzene, 2,2'-bis[3(3-aminophenoxy)phenyl]hexafluoropropane, 2,2'-bis[4(4-aminophenoxy)phenyl]hexafluoropropane, 2,2'-bis(3-aminophenyl)hexafluoropropane, 2,2'-bis(4-aminophenyl)hexafluoropropane, and oxydianiline.

7. The conductive laminate as set forth in claim 6, wherein the conductive layer has a thickness ranging from 10 nm to 5 μm.

8. The conductive laminate as set forth in claim 6, having a light transmittance of 70% or more at 550 nm and a surface resistivity of 1,000 Ω/sq or less.

9. The conductive laminate as set forth in claim 6, wherein the copolymer of (meth)acrylic acid and (meth)acrylic acid ester further comprises a monomeric unit selected from the group consisting of acryl amide, methacryl amide, styrene, and α-methyl styrene.

10. A conductive layer comprising carbon nanotubes and having at least two pyrolysis onsets showing at least 5% weight reduction in a pyrolysis range of 200-900° C., the pyrolysis range including a first pyrolysis range which initiates pyrolysis at 200-450° C. and shows a weight reduction of W1% and a second pyrolysis range which initiates pyrolysis at 450-700° C. and shows a weight reduction of W2%, and the W 1/W2 being 0.1-20, said conductive layer being obtained from a composition comprising an alkali-soluble binder resin, a photopolymerizable compound, a photoinitiator, and carbon nanotubes, in which a ratio of an amount of the carbon nanotubes and a total amount of the alkali-soluble binder resin and the photopolymerizable compound is 1:0.2 to 1:10.0 by weight, and a ratio of an amount of the alkali-soluble binder resin and an amount of the photopolymerizable compound is 1:0.1 to 1:2 by weight based on solid content of the composition;

wherein the alkali-soluble binder resin and the photopolyerizable compound are different from each other, and the alkali-soluble binder resin is a copolymer of (meth) acrylic and (meth)acrylic acid ester, or a hydroxypropyl methylcellulose acetate phthalate ester;

wherein the conductive layer is provided on a surface of a substrate;

wherein the substrate is a polyimide film manufactured by polymerizing an aromatic dianhydride and an aromatic diamine to form a polyamic acid, which is then subject to an imidization to give the polyimide film, and wherein the polyimide film has an average coefficient of linear thermal expansion of 35 ppm/° C. or less measured at 50-250 ° C. using thermomechanical analysis at a film thickness of 50-100 μm;

wherein the aromatic dianhydride includes one or more selected from the group consisting of 2,2-bis(3,4-dicarboxyphenyl)hexafluoropropane dianhydride, 4-(2,5-dioxotetrahydrofuran-3-yl)-1,2,3,4-tetrahydronaphthalene-1,2-dicarboxylic anhydride, 4,4'-(4,4'-isopropylidenediphenoxy)bis(phthalic anhydride), pyromellitic dianhydride, biphenyltetracarboxylic dianhydride, and oxydiphthalic dianhydride; and wherein the aromatic diamine includes one or more selected from the group consisting of 2,2-bis[4-(4-aminophenoxy)-phenyl]propane, 2,2'-bis(trifluoromethyl)-4,4'-diaminobiphenyl, 3,3'-bis(trifluoromethyl)-4,4'-diaminobiphenyl, 4,4'-bis(3-aminophenoxy) diphenylsulfone, bis(3-aminophenyl)sulfone, bis(4-aminophenyl)sulfone, 1,3-bis(3-aminophenoxy) benzene, 1,4-bis(4-aminophenoxy)benzene, 2,2'-bis[3(3-aminophenoxy)phenyl]hexafluoropropane, 2,2'-bis[4(4-aminophenoxy)phenyl]hexafluoropropane, 2,2'-bis(3-aminophenyl)hexafluoropropane, 2,2'-bis(4-aminophenyl)hexafluoropropane, and oxydianiline.

11. The conductive layer as set forth in claim 10, having a thickness ranging from 10 nm to 5 μm.

12. The conductive layer as set forth in claim 10, having a light transmittance of 70% or more at 550 nm and a surface resistivity of 1,000 Ω/sq or less.

13. The conductive layer as set forth in claim 10, wherein the copolymer of (meth)acrylic acid and (meth)acrylic acid ester further comprises a monomeric unit selected from the group consisting of acryl amide, methacryl amide, styrene, and α-methyl styrene.

* * * * *